US011339936B2

(12) United States Patent
Dong

(10) Patent No.: US 11,339,936 B2
(45) Date of Patent: May 24, 2022

(54) FLICKERING FLAME-SHAPED HEAD APPARATUS

(71) Applicant: Haisong Dong, Dongguan (CN)

(72) Inventor: Haisong Dong, Dongguan (CN)

(73) Assignee: Haisong Dong, Dongguan (CN)

( * ) Notice: Subject to any disclaimer, the term of this patent is extended or adjusted under 35 U.S.C. 154(b) by 0 days.

(21) Appl. No.: 17/111,552

(22) Filed: Dec. 4, 2020

(65) Prior Publication Data

US 2021/0102675 A1 Apr. 8, 2021

Related U.S. Application Data

(63) Continuation of application No. PCT/CN2019/090231, filed on Jun. 6, 2019.

(30) Foreign Application Priority Data

Jun. 8, 2018 (CN) ..... 201810585874.6

(51) Int. Cl.
*F21S 10/04* (2006.01)
*F21V 23/00* (2015.01)
*F21Y 115/10* (2016.01)

(52) U.S. Cl.
CPC ..... *F21S 10/046* (2013.01); *F21V 23/002* (2013.01); *F21Y 2115/10* (2016.08)

(58) Field of Classification Search
CPC .... F21S 10/046; F21V 23/002; F21Y 2115/10
See application file for complete search history.

(56) References Cited

U.S. PATENT DOCUMENTS

2014/0211499 A1* 7/2014 Fong ..... F21S 9/02 362/558
2016/0290579 A1* 10/2016 Au ..... F21S 6/001
(Continued)

FOREIGN PATENT DOCUMENTS

CN 203442498 U 2/2014
CN 208349193 U 1/2019

*Primary Examiner* — Bryon T Gyllstrom
*Assistant Examiner* — Christopher E Dunay
(74) *Attorney, Agent, or Firm* — PROI Intellectual Property US

(57) ABSTRACT

Disclosed is a swinging flame head device, comprising a fixed housing (1), a flame head housing (5), a light source (61) and a spring (4). The fixed housing (1) has an internal space and an upper opening, the flame head housing (5) comprises a stereoscopic flame-shaped portion and has an internal hollow structure, and the flame head housing (5) is at least partially located above the upper opening of the fixed housing (1). The light source (61) is arranged inside the flame head housing (5), and light rays emitted from the light source (61) illuminate the flame head housing (5) from inside to outside from the interior of the flame head housing (5). The spring (4) has an upper and a lower end, wherein the flame head housing (5) is supported on the upper end of the spring (4), and the disturbance of the spring (4) brings about the movement of the flame head housing (5) relative to the fixed housing (1), or the light source (61) is fixed to the upper end of the spring (4), and the disturbance of the spring (4) brings about the movement of the light source (61) relative to the fixed housing (1). The device has a simple structure, and generates a decorative lighting effect of flame flickering at any angle.

20 Claims, 10 Drawing Sheets

(56) References Cited

U.S. PATENT DOCUMENTS

| | | | | |
|---|---|---|---|---|
| 2017/0089548 | A1* | 3/2017 | Yang | F21L 4/02 |
| 2017/0370541 | A1* | 12/2017 | Huang | F21S 10/046 |
| 2018/0010750 | A1* | 1/2018 | Cheng | F21V 14/02 |
| 2020/0191348 | A1* | 6/2020 | Fan | F21S 10/046 |
| 2021/0048173 | A1* | 2/2021 | Li | F21V 15/01 |

* cited by examiner

FLICKERING FLAME-SHAPED HEAD APPARATUS

FIELD OF TECHNOLOGY

The present invention relates to the technical field of simulated electronic candles. More specifically, the present invention relates to a flickering flame-shaped head apparatus and an electronic candle with flickering flame-shaped head apparatus.

BACKGROUND TECHNOLOGY

As an important decoration, candles are widely used in important occasions such as birthday parties and candlelight dinners, with the function of adjusting the atmosphere. However, when traditional candles are lit, they not only produce smoke and pollute the environment, but open flames also bring safety risks. Therefore, traditional candles are increasingly replaced by electronic candles.

To bring the reality of the flickering candlelight, CN 205606453 U discloses an electronic candle that generates the flickering lighting effect of the candlelight through the disturbance of spring. The electronic candle includes an angled reflection screen, which is movably supported on a housing through a spring, and a plurality of color flame projectors matched with the angled reflection screen are arranged on the housing. When the driving drives the angled reflection screen to flickering, the angled reflection screen produces flickering flame effect due to the irradiation of the flame projector. The light beam of CN 205606453 U is irradiated from the outside of the flame-shaped head to the flame-shaped head. In order to achieve three-dimensional effect from various views to the simulated flame, multiple flame projectors and angled reflective screens are needed. Therefore, although the spring is used in CN 205606453 U to produce the flickering effect of candlelight, its structure is complicated and it is impossible to bring three-dimensional effect from any viewing angles.

SUMMARY

The technical problem to be solved by the present invention is to propose a flickering flame-shaped head apparatus with simple structure and three-dimensional effect when viewed from any angle.

The technical solution adopted by the invention to solve the technical problem includes:

A flickering flame-shaped head apparatus comprises a housing, a flame-shaped head, a light source and a spring, wherein the housing has an inner space and an upper opening, and the flame-shaped head comprises a three-dimensional flame-shaped part with an interior hollow structure, the flame-shaped head is at least partially located above the upper opening of the housing; the light source is disposed inside the flame-shaped head; and the flame-shaped head is illuminated by the light emitted by the light source, from inside to outside, the spring has a upper and a lower ends, the flame-shaped head is supported on the upper end of the spring, the disturbance of the spring drives the flame-shaped head to move relative to the housing.

In further:

The lower end of the spring is supported on the housing.

The spring has an inner space that penetrates both upper and lower portions thoroughly, which is surrounded by a spring wire, and the housing is provided with a light source fixing protrusion, and the light source fixing protrusion passes through the inner space of the spring, the light source is fixed on the upper end of the light source fixing protrusion.

It also includes a driving device that causes the spring to be disturbed

The driving device drives the spring to rotate, and to be further disturbed.

The driving device is equipped with a motor, which is fixed on the housing; the motor has a rotating shaft, and the lower end of the spring is fixed to the rotating shaft, the rotation of the rotating shaft is capable to drive the spring to rotate.

It also includes a spring support and a driving device, the lower end of the spring is supported on the spring support, and the driving device drives the spring support to move relative to the housing, causes the disturbance of the spring The wire diameter of the spring is not larger than 0.5 mm.

A flickering flame-shaped head apparatus comprises of a housing, a flame-shaped head, a light source and a spring, wherein the housing has an inner space and an upper opening, and the flame-shaped head comprises a three-dimensional flame-shaped part with an interior hollow structure, the flame-shaped head is at least partially located above the upper opening of the housing; the light source is disposed inside the flame-shaped head; and the flame-shaped head is illuminated by the light emitted by the light source, from inside to outside, the spring has a upper and a lower ends, the flame light source is supported on the upper end of the spring, the disturbance of the spring drives the light source to move relative to the housing.

In further:

At least one light source conductive wire with wire diameter of less than 0.5 mm, one end of which is electrically connected to at least one electrode of the said light source and the other end of which is electrically connected to the light source control unit.

At least one light source conductive wire is enameled wire, bare metal wire or metal electroplated fiber wire, one end of which is electrically connected to at least one electrode of the said light source and the other end of which is electrically connected to the light source control unit.

The flickering flame-shaped head apparatus further comprises at least one light source conductive wire, one end of the light source of the light source conductive wire is electrically connected to at least one electrode of said light source and the other end of the light source conductive wire is electrically connected to the light source control unit; the spring has an inner space that penetrates both upper and lower portions, which is surrounded by a spring wire, and at least one section of the light source conductive wire is located in the inner space of the said spring.

The spring serves as a conductor, the upper end of the spring is connected to at least one electrode of the light source, the lower end of the spring is electrically connected to the light source control unit.

The number of the springs should be at least two, the upper ends of the two springs are electrically connected to two electrodes of said light source respectively, the lower ends of said spring are electrically connected to the light source control unit.

One of the two springs has an internal space running from top to bottom, surrounded by the spring wire; the other spring is located in said internal space.

A driving device drives the spring to be disturbed.

The driving device drives the spring to rotate to generate disturbance.

A motor is fixed on the housing, the motor has a rotating shaft, and the rotating shaft is electrically connected with at least one electrode of said light source, the lower end of the spring is fixed to said rotating shaft, the said rotating shaft drives said spring to cause the disturbances.

The metal housing of the motor is electrically connected to the light source control unit.

The flickering flame-shaped head apparatus includes a conductive ring and a conductive elastic sheet, the conductive ring has annular outer surface, and the conductive ring is fixed to the lower end of the spring, the movement of the conductive ring may cause the disturbance of the spring; the conductive elastic sheet has an elastic end and a fixed end; the fixed end of the conductive elastic sheet is fixed on the housing, and the elastic end of the conductive elastic sheet is in elastic contact and electrically connected with the annular outer surface of conductive ring, and the at least one light source electrode is electrically connected with the conductive ring, the conductive elastic sheet is electrically connected to the light source control unit.

It also includes a spring support and a driving device, the lower end of the spring is supported on the spring support, and the driving device drives the spring support to move relative to the housing, thereby causing disturbance of the spring.

The wire diameter of the spring is less than 0.5 mm.

The flickering flame-shaped head apparatus further comprises a motor driving spring disturbance, the first light source electrode is electrically connected to the upper end of the light source conductive wire, the lower end of the light source conductive wire is electrically connected to the motor rotating shaft, the metal housing surface of the motor is electrically connected to the first electrode wire; the first light source electrode is electrically connected to the first electrode wire through the light source conductive wire, the motor rotating shaft and the metal housing surface of the motor in turn; the second light source electrode is electrically connected to the upper end of the spring, the lower end of the spring is electrically connected to the conductive ring; the second electrode wire is electrically connected to the conductive elastic sheet that is in contact with the annular outer surface of conductive ring, when the conductive ring is driven by the motor to rotate, the conductive elastic sheet always keeps in contact with the annular outer surface of conductive ring, and the second light source electrode is electrically connected with the second electrode wire through the spring, the conductive ring and the conductive elastic sheet in turn.

The flickering flame-shaped head apparatus also includes a rotating shaft fixing plug, the conductive ring is sleeved on the outer surface of the rotating shaft fixing plug, and the lower end of the spring is arranged between the rotating shaft fixing plug and the conductive ring.

The flickering flame-shaped head apparatus also includes a light source fixing plug, and the upper end of the spring, passing through the light source fixing plug, is fixed to the light source.

The flame-shaped head is connected to the light source fixing plug.

A flickering flame-shaped head apparatus comprises a housing, a flame-shaped head, a light source and a spring, wherein the apparatus includes a transparent light pipe connected to the light source; the housing has an inner space and an upper opening, and the flame-shaped head comprises a three-dimensional flame-shaped part with an interior hollow structure, the flame-shaped head is at least partially located above the upper opening of the housing; the light source is disposed inside the flame-shaped head; and the flame-shaped head is illuminated by the light beam emitted by the light source, such light beam passes through the transparent light pipe to the inner space of flame-shaped head and then is emitted through from inside to outside, the spring has a upper and a lower ends, the flame-shaped head is supported on the upper end of the spring, the disturbance of the spring drives the flame-shaped head to move relative to the housing.

Compared with the prior art, the flame-shaped head of the invention is designed as a three-dimensional shape like a flame, and the interior is hollow. The light source is placed inside the flame-shaped head, and the light emitted by the light source is emitted from the inside of the flame-shaped head through flame-shaped head, so only one light source inside the flame-shaped head is needed; and the spring is directly connected with the flame-shaped head or the light source, and the structure is simple, any angle of view has the flame flickering and jumping lighting effect.

DETAILED DESCRIPTION

Figure 1:
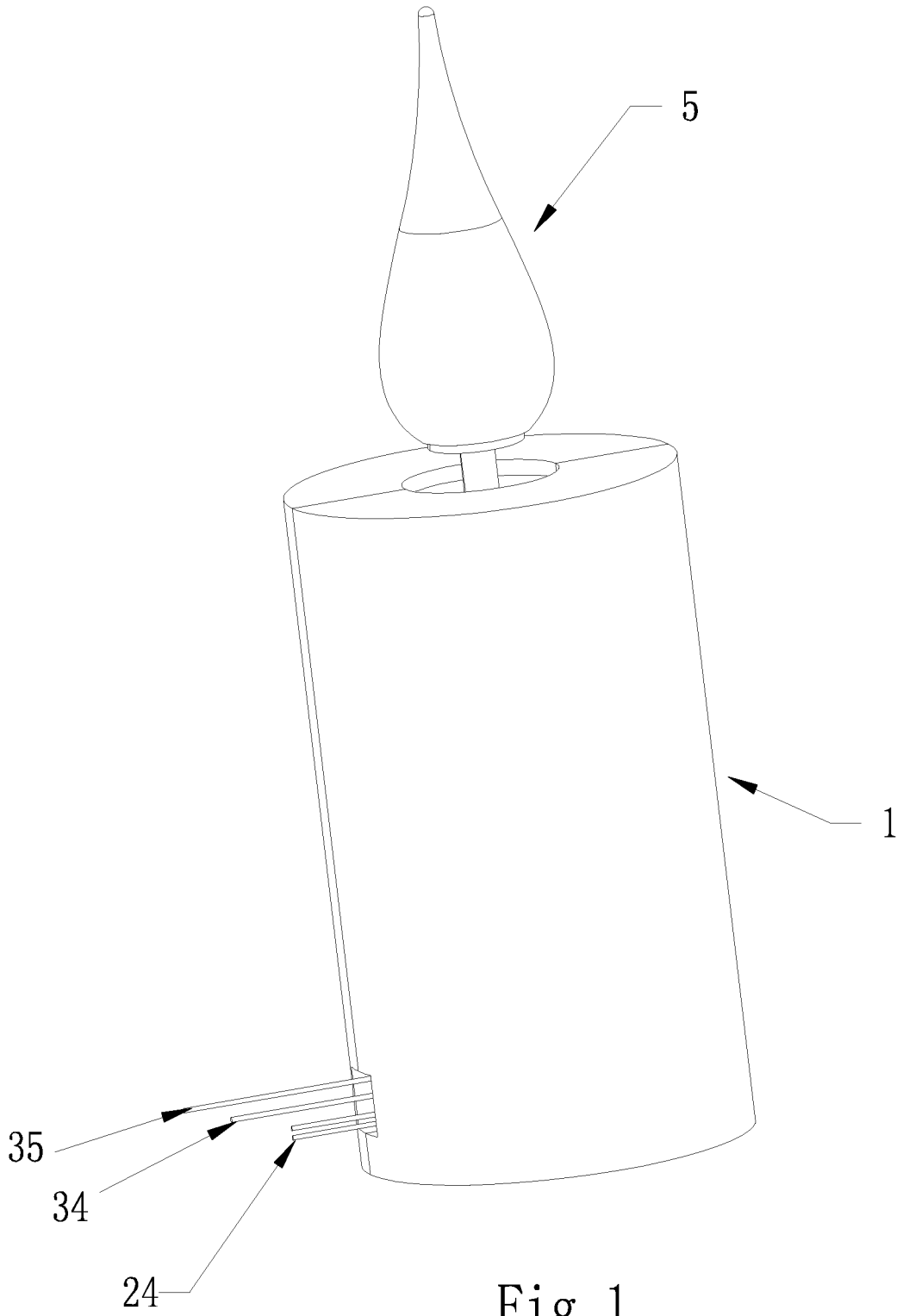
FIG. 1 is a schematic diagram depicting the external shape of Embodiment 1 of flickering flame-shaped head apparatus in the present invention.

The embodiments of the present invention are hereby described in details with reference to the figures.

As shown in FIGS. 1-9, a flickering flame-shaped head apparatus is composed of a housing 1, a flame-shaped head 5, a light source 61 and a spring 4. The housing 1 has an inner space and an upper opening. The flame-shaped head 5 includes a three-dimensional flame-shaped part and has an inner hollow structure. The flame-shaped head 5 is at least partially located above the upper opening of the housing 1. The light source 61 is arranged inside the flame-shaped head 5, the flame-shaped head 5 is illuminated by the light beam emitted from the light source 61 through the flame-shaped head from inside to outside. The spring 4 has upper and lower ends, the flame-shaped head 5 is supported on the upper end of the spring 4, the spring 4 disturbance drives flame-shaped head 5 to move relative to the housing 1. Alternatively, the light source 61 is fixed in the upper end 4 of the spring, the spring 4 disturbance causes the light source 61 to move relative to the housing 1.

The wire diameter of spring 4 is recommended to be within 0.5 mm to achieve a better flickering effect. The diameter of the light source conductive wire 33 is recommended to be within 0.5 mm to achieve a better flickering effect. The light source conductive wire 33 may be enameled wire, bare metal wire, or metal electroplated fiber wire, instead of the conductive wire with a plastic or rubber insulating sleeve commonly used in market, in order to achieve a better flickering effect. The light source 61 is made of LED.

The disturbance of the spring 4 can be realized by means of an driving or naturally under the action of air flow force.

It also includes a spring support and an driving, the lower end of the spring 4 is supported or connected (in a fixed or movable manner) on the spring support, and the driving drives the spring support to move relative to the housing 1. The spring support can be composed of one or more separate parts, and the spring support is movable (directly or indirectly) on the housing 1, and is allowed to move in a certain form relative to the housing 1, such as rotating movement, upward and downward movement, horizontal movement, etc., or any combination of the aforesaid movements. In the embodiments shown in FIGS. 1 to 6, the spring support may be the rotating shaft fixing plug 23 or composed of the combination of the rotating shaft fixing plug 23 and the conductive ring 31, available in rotating relative to the housing 1.

The lower end of the spring 4 can also be supported on the housing 1.

Figure 2:
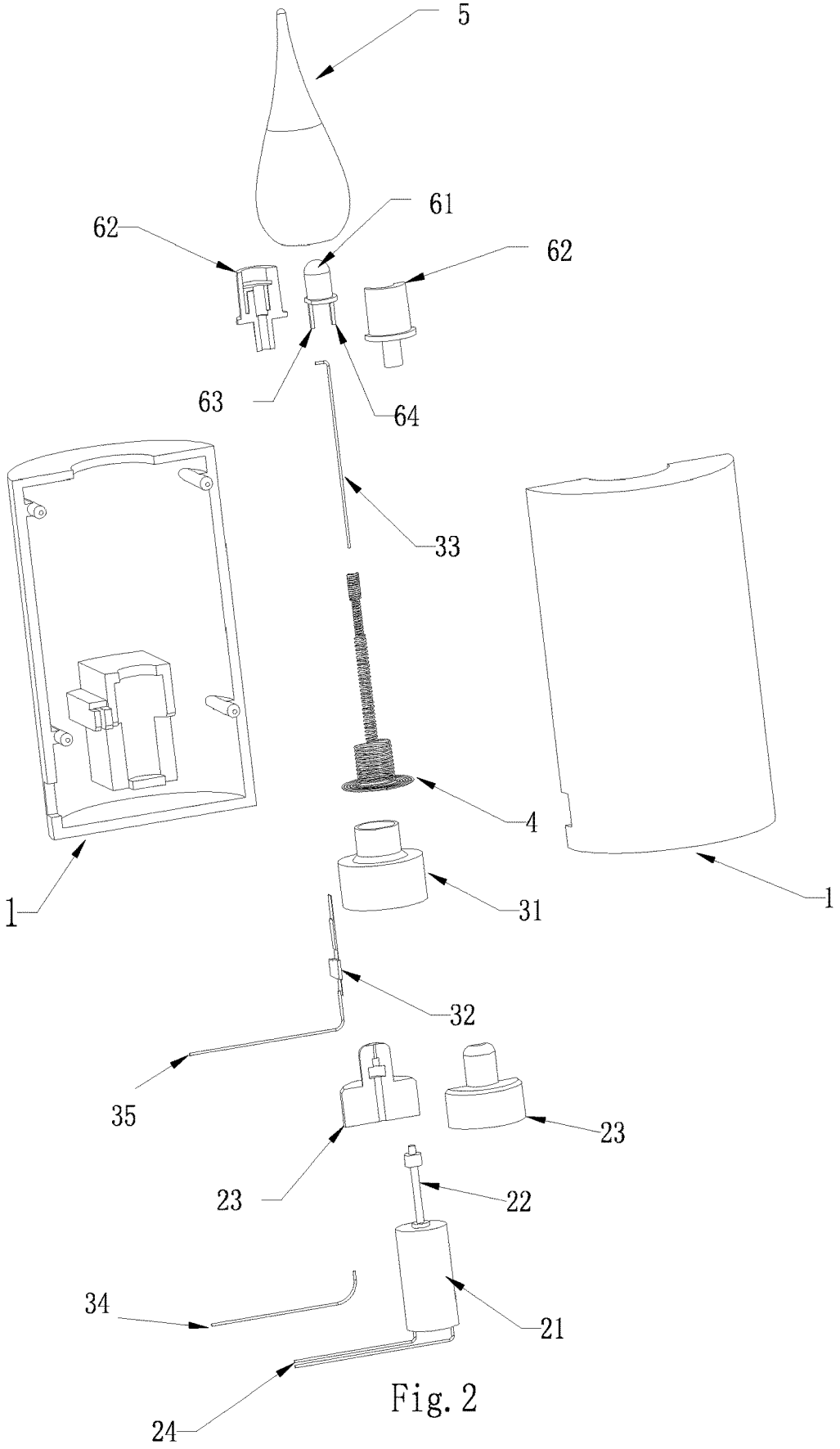
FIG. 2 is a schematic diagram depicting the disassembled state of Embodiment 1 of a flickering flame-shaped head apparatus in the present invention.

For a flickering flame-shaped head apparatus, Embodiment 1 is shown in FIGS. 1-4, wherein the light source 61 is fixed to the upper end of the spring 4, the spring 4 disturbance drives light source 61 to move relative to the housing 1. As shown in FIGS. 1 and 2, it comprises a housing 1, an driving device positioned within the housing 1, the conductive assembly and spring 4, flame-shaped head 5 positioned above the housing 1, and light source assembly inside the flame-shaped head 5. Wherein, the driving device is designed as a motor assembly, including a motor 21, a rotating shaft 22, a rotating shaft fixing plug 23 and a motor power cord 24. The motor 21 is fixed on the housing 1, and the rotation of the rotating shaft drives the spring to rotate. The conductive assembly includes a conductive ring 31, a conductive elastic sheet 32, a light source conductive wire 33, first electrode wire 34 and second electrode wire 35. The light source assembly includes a light source 61, a light source fixing plug 62, and first electrode 63 and second electrode 64. The spring 4 has an inner space that penetrates both upper and lower portions thoroughly, which is surrounded by a spring wire, and at least a section of the light source conductive wire 33 is located in the inner space of the spring 4.

As shown in FIG. 1, the motor power cord 24, the first electrode wire 34 and the second electrode wire 35 are extended out of the housing 1.

Figure 3:
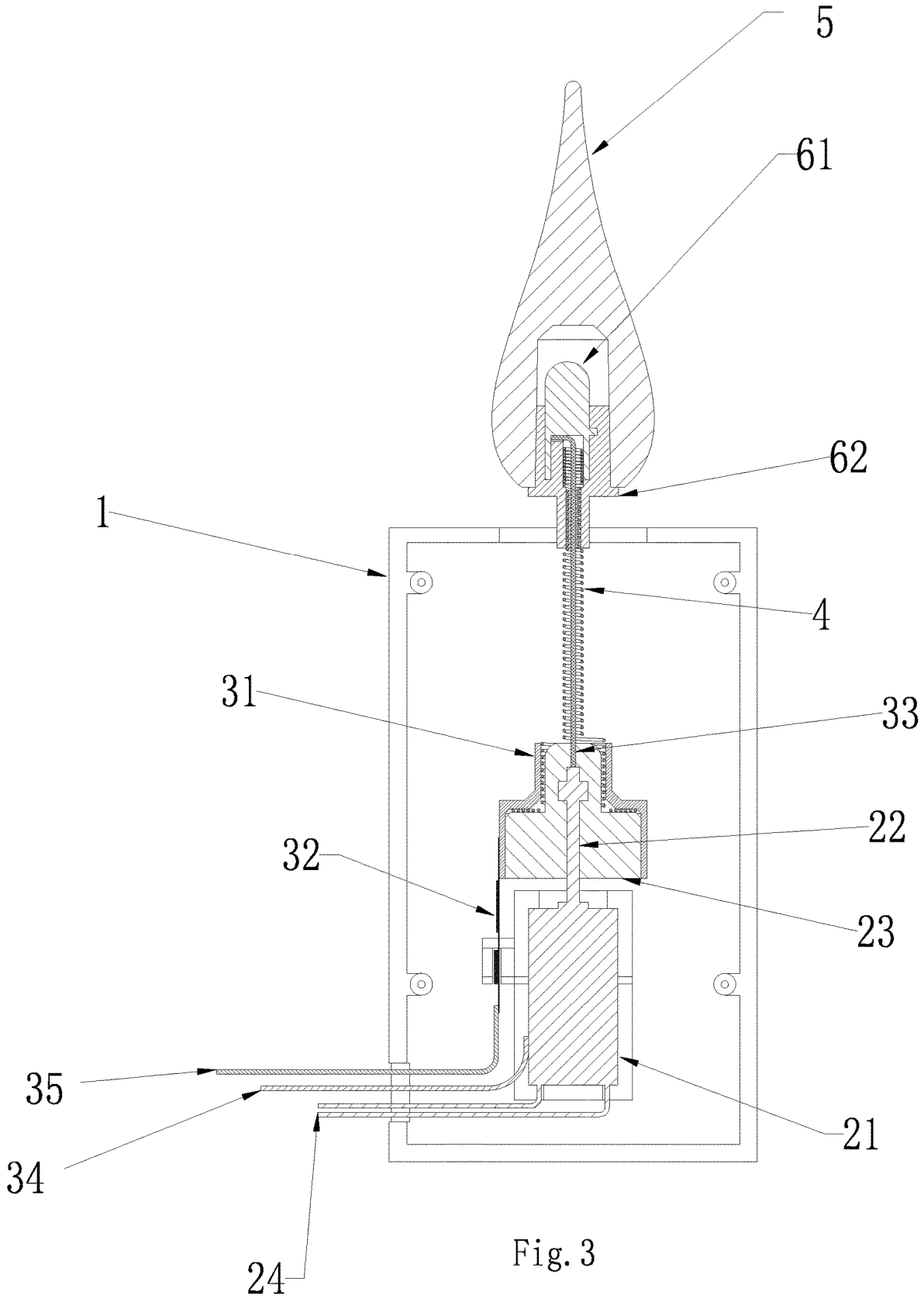
FIG. 3 is schematic diagram depicting the cross-sectional structure of Embodiment 1 of a flickering flame-shaped head apparatus in the present invention.
Figure 4:
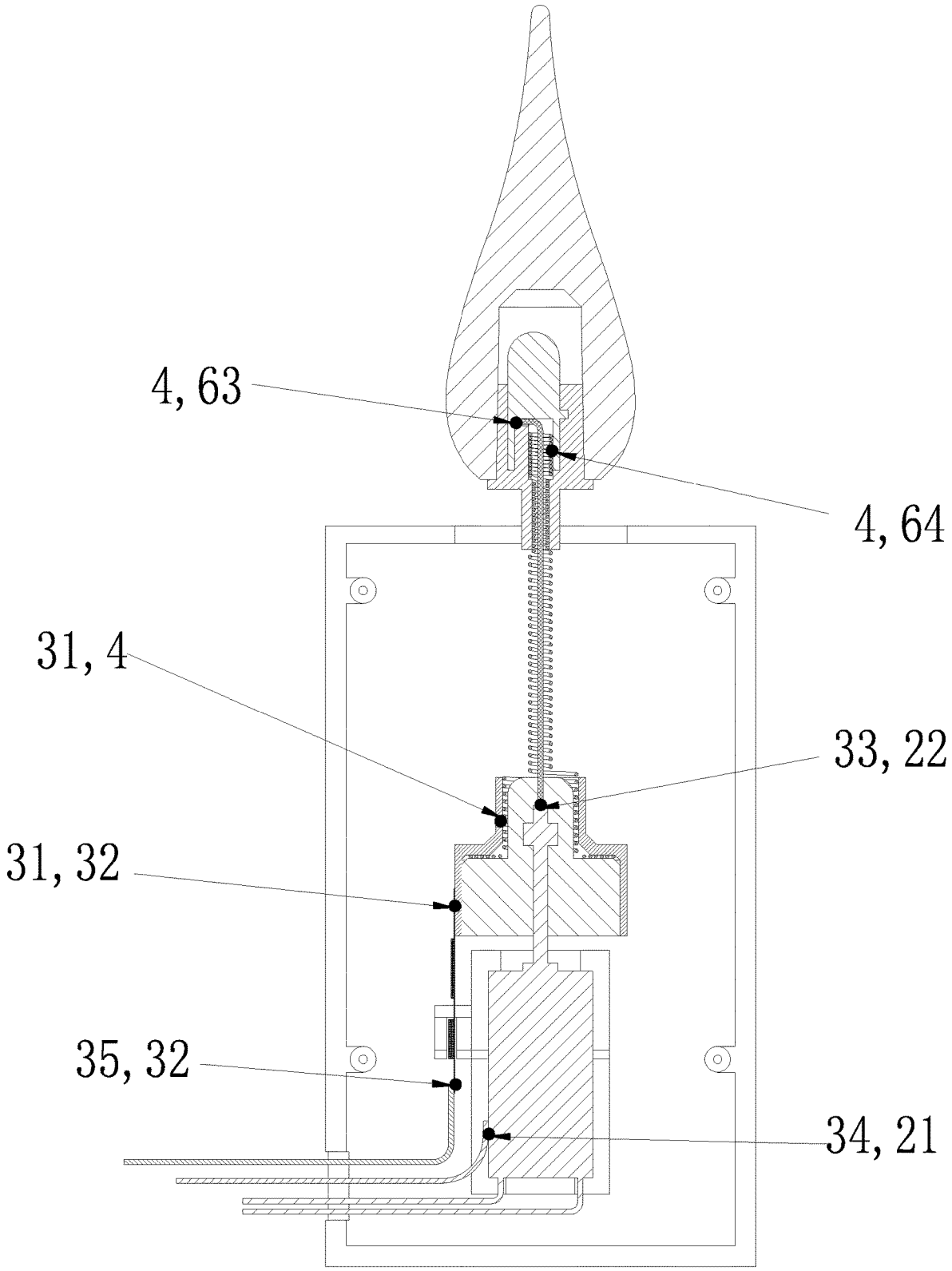
FIG. 4 is a schematic diagram depicting the electrical connection of Embodiment 1 of a flickering flame-shaped head apparatus in the present invention.

As shown in FIG. 3, the conductive ring 31 has a annular outer surface, the conductive ring 31 is sleeved on the outer surface of the rotating shaft fixing plug 23, and the lower end of the spring 4 is clamped between the rotating shaft fixing plug 23 and the conductive ring 31. The conductive elastic sheet 32 is provided with an elastic end and a fixed end. The fixed end of the conductive elastic sheet 32 is fixed on the housing 1, and the elastic end is kept in a separable pressure contact state with the rotating outer surface of the conductive ring 31 and is electrically conductive. The upper end of the spring 4 passes through the light source fixing plug 62 and is fixed to the light source 61. The flame-shaped head 5 is connected and fixed with the light source fixing plug 62.

The rotating shaft 22 of the motor 21 rotates, thereby driving the rotating shaft fixing plug 23, the spring 4, the conductive ring 31 and the light source conductive wire 33 to rotate together, further causing the light source fixing plug 62, the light source 61 and the flame-shaped head 5 to rotate together. When the flame-shaped head 5 and the light source 61 are disturbed by the rotating force of the spring 4, the flame-shaped head 5 and the light source 61 will rock and generate flickering effect accordingly.

The motor 21 is electrically connected to a driving control unit (not shown in the figure) through a motor power cord 24, and the control unit controls the speed and stop of the motor rotation to achieve different simulation effects.

The driving device is not limited to the motor assembly in Embodiment 1, and may be designed as other types, such as the iron sheet fixed on the spring and the magnetic coil as disclosed in CN 205606453 U.

As shown in Embodiment 4, the first light source electrode 63 is electrically connected to the upper end of the conductive wire 33, the light source conductive wire's lower end is electrically connected to the motor rotating shaft 22; the first electrode wire 34 is electrically connected to the surface of the metal housing of the motor. Due to electrical connection between the rotating shaft 22 and the metal housing of the motor, the first light source electrode 63 is electrically connected with the first electrode wire 34 through the light source conductive wire 33 and the rotating shaft 22. The second light source electrode 64 is electrically connected to the upper end of the spring 4, the lower end of the spring 4 sleeved on and electrically connected with the conductive ring, the second electrode wire 35 is electrically connected to the conductive elastic sheet 32. The elastic end of the conductive elastic sheet 32 is attached to the annular outer surface of the conductive ring 31, when the conductive ring 31 is rotated by the motor, the conductive elastic sheet 32 is always in contact with the annular outer surface of the conductive ring. Therefore, the second light source electrode 64 is electrically connected to the second electrode wire 35 through the spring 4, the conductive ring 31 and the conductive elastic sheet 32 in turn. The first electrode wire 34 and the second electrode wire 35 are electrically connected to a light source control unit (not shown in the figure), and the light source control unit controls the light source to turn on and off, or flicker, etc., to achieve different simulation effects.

The first embodiment shows a spring structure. In this embodiment, the spring itself is used as a light source conductive wire to lead a light source electrode, and another separate light source conductive wire leads to another light source electrode. In other embodiments, two light source conductive wires can also be set to lead light source electrodes respectively. The light source conductive wire is made of enameled wire, bare metal wire or metal electroplated fiber wire. In this embodiment, a motor is provided to drive the spring disturbance. When an driving device is not provided to drive, natural flickering is realized under the action of air flow, one end of the light source conductive wire is electrically connected to the light source electrode, and the other end is electrically connected to the light source control unit.

Figure 5:
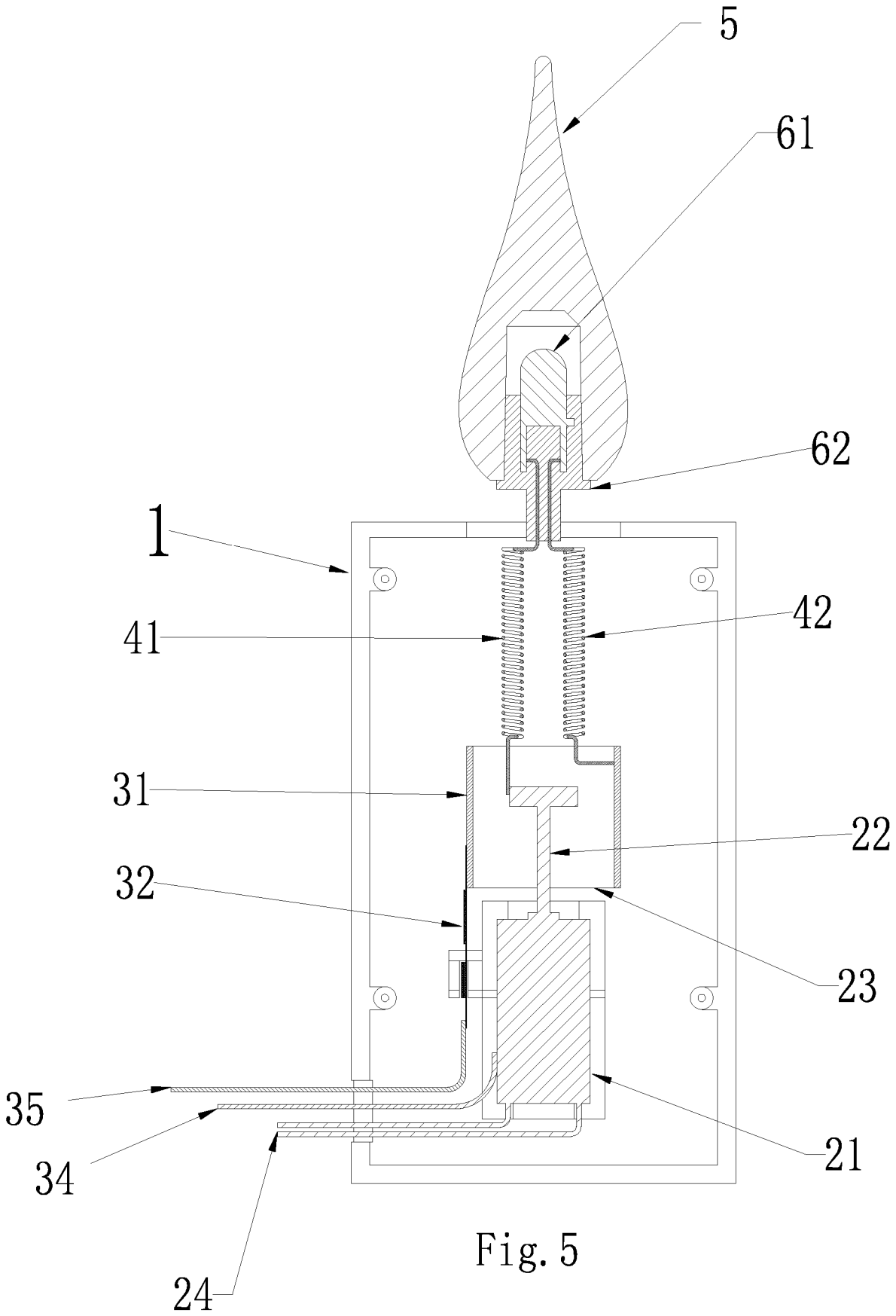
FIG. 5 is a schematic diagram depicting the cross-sectional structure of Embodiment 2 of a flickering flame-shaped head apparatus in the present invention.

In another embodiment, the number of springs should be two or more. Double-spring design is described in Embodiment 2, shown in FIGS. 5 and 6, wherein two springs are driven by the driving device, a majority of structure is similar as Embodiment 1. As shown in FIG. 5, Embodiment 2 comprises a housing 1, driving assembly, conductive assembly, first spring 41, second spring 42, inside said housing 1, the flame-shaped head 5 above housing 1, and light source assembly inside flame-shaped head 5. Wherein, the driving is designed as a motor assembly, including a motor 21, a rotating shaft 22, a rotating shaft fixing plug 23 and a motor power cord 24. The conductive assembly includes a conductive ring 31, a conductive elastic sheet 32, first electrode wire 34 and second electrode wire 35. The light source assembly includes a light source 61 and a light source fixing plug 62. The rotating shaft 22 of the motor 21 rotates, driving the rotating shaft fixing plug 23, the conductive ring 31, the first spring 41, the second spring 42, the light source fixing plug 62, the light source 61 and the flame-shaped head 5 to rotate together. The flame-shaped head 5 and the light source 61 are supported by the first spring 41 and the second spring 42, when the first spring 41 and the second spring 42 are disturbed by the rotating force, the flame-shaped head 5 and the light source 61 are driven to rock to produce the flickering effect of flame.

Figure 6:
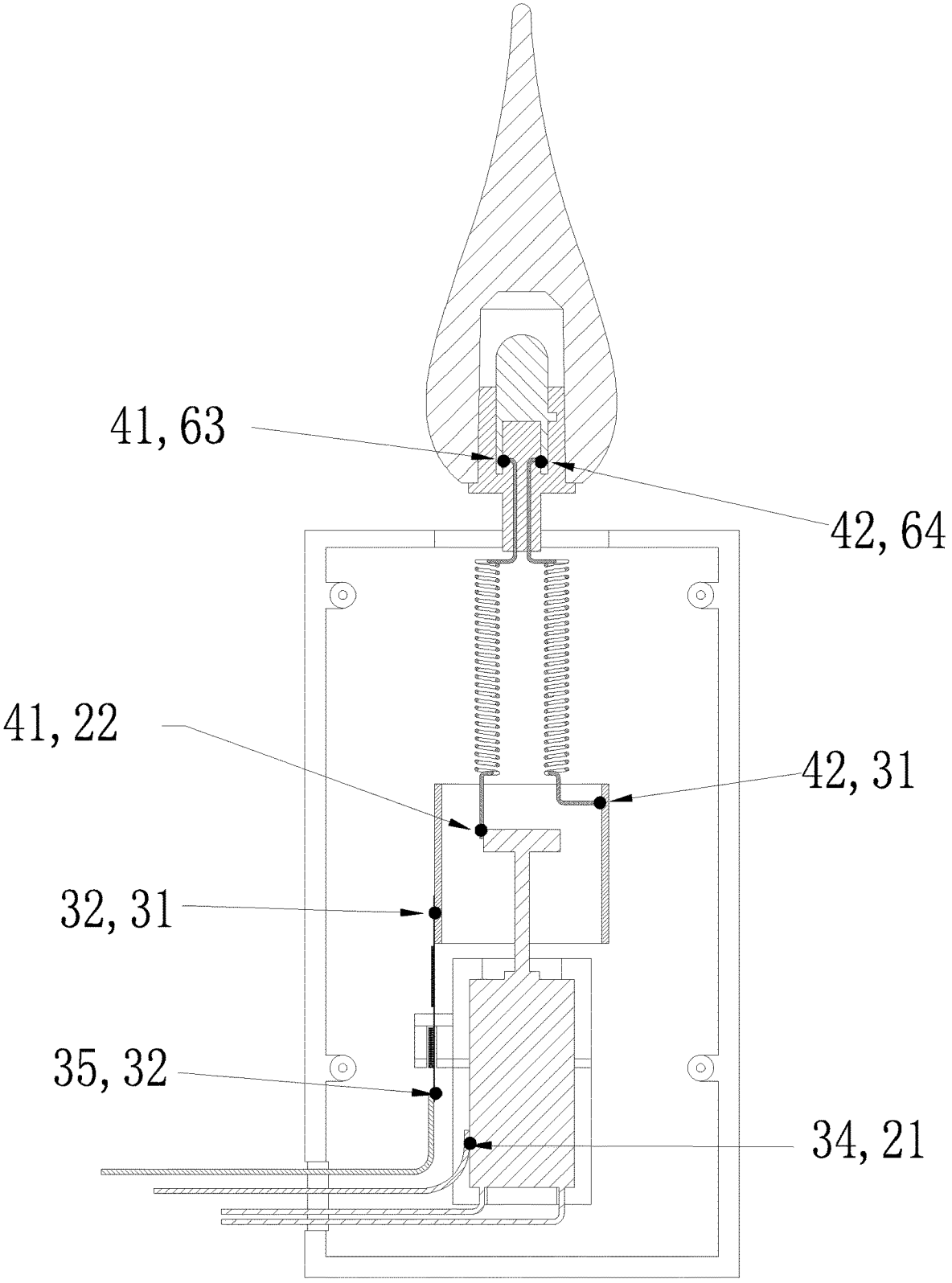
FIG. 6 is a schematic diagram depicting the electrical connection of Embodiment 2 of a flickering flame-shaped head apparatus in the present invention.

As shown in FIG. 6, the first light source electrode 63 and the upper end of the first spring 41 are electrically connected; the lower end of first spring 41 and the motor rotating shaft 22 are electrically connected; the first electrode wire 34 is electrically connected to the motor metal housing surface. The rotating shaft 22 is electrically connected with the metal housing of the motor, therefore the first light source electrode 63 is electrically connected to the first electrode wire 34 through the first spring 41 and the rotating shaft 22 in turn. The second light source electrode 64 is electrically connected to the upper end of the second spring 42, the lower end of the second spring 42 is electrically connected to the conductive ring 31; the second electrode wire 35 is electrically connected to the conductive elastic sheet 32. The front end of the conductive elastic sheet 32 is attached to the annular outer surface of the conductive ring 31, when the conductive ring 31 is rotated by the motor, the conductive elastic sheet 32 is always in contact with the annular outer surface of the conductive ring. Therefore, the second light source electrode 64 is electrically connected to the second electrode wire 35 through the second spring 42, the conductive ring 31, and the conductive elastic sheet 32 in turn.

The two springs in Embodiment 2 may be replaced by one spring having an inner space running from top to bottom, surrounded by the spring wire, and another spring arranged in the internal space.

Figure 7:
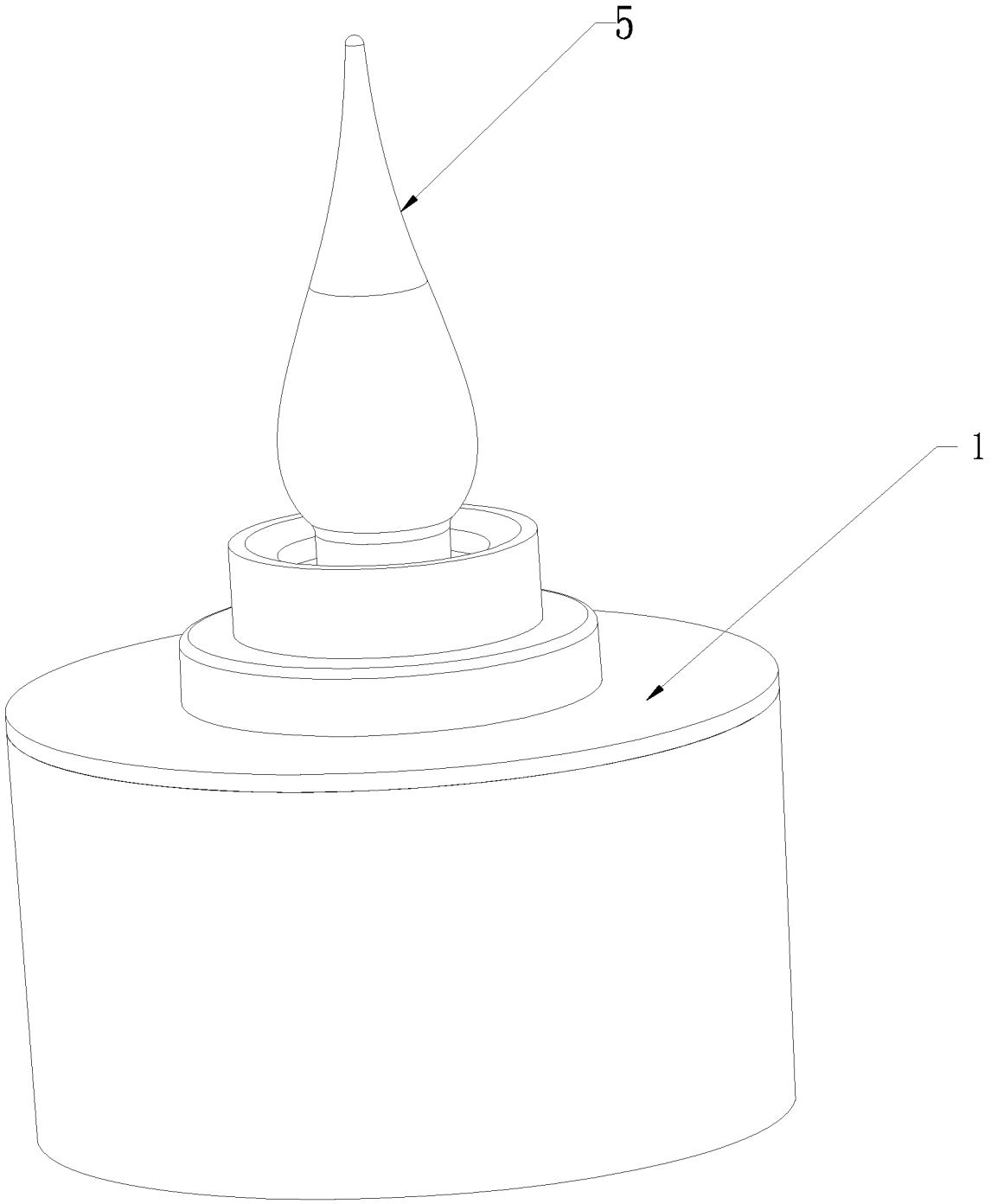
FIG. 7 is a schematic diagram depicting the external shape of Embodiment 3 of a flickering flame-shaped head apparatus in the present invention.
Figure 8:
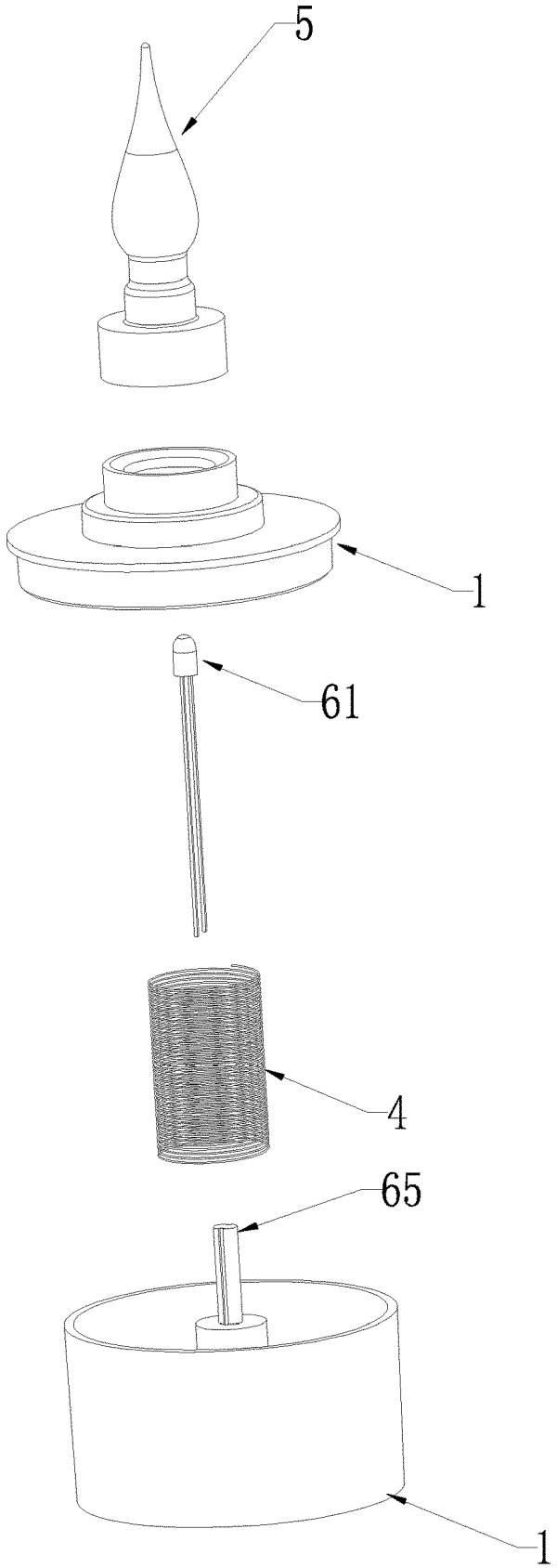
FIG. 8 is a schematic diagram depicting the disassembled state of Embodiment 3 of a flickering flame-shaped head apparatus in the present invention.
Figure 9:
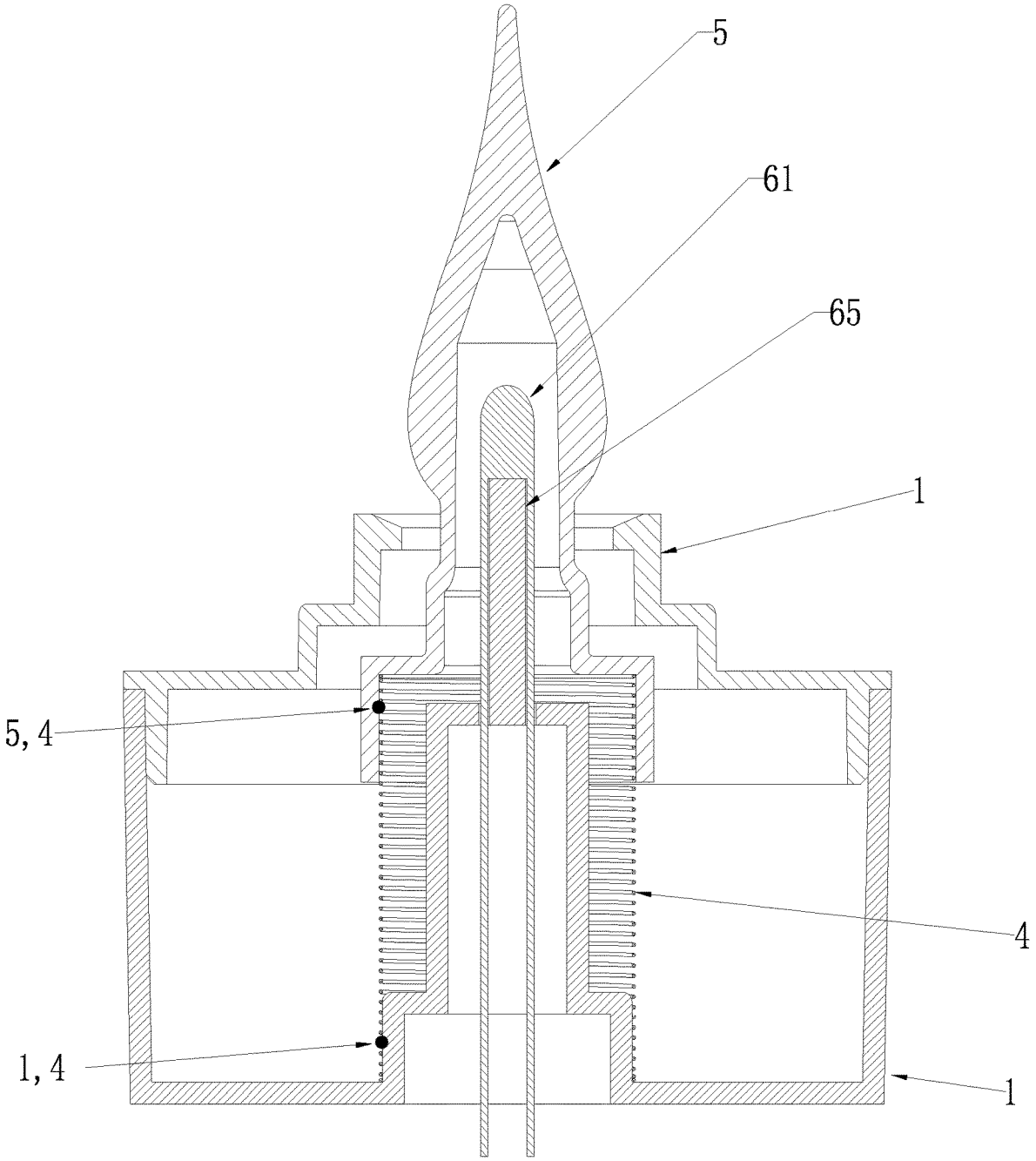
FIG. 9 is a schematic diagram depicting the cross-sectional structure of Embodiment 3 of a flickering flame-shaped head apparatus in the present invention.

As shown in FIGS. 7-9, Embodiment 3 includes a flame-shaped head 5, a housing 1, a light source 61 housed in the flame-shaped head 5, and a spring 4 and a light source fixing protrusion 65 housed in the housing 1. As shown in FIG. 9, the upper end of the flame-shaped head 5 is connected with the spring 4 in a fixed or moveable manner. The lower end of spring 4 is connected to the bottom of the housing 1. The flame-shaped head 5 is movably supported on the housing 1 through the spring 4, and the light source 61 is located inside the flame-shaped head 5 and fixed above the light source fixing protrusion 65, located in the middle of the housing 1. Under the force of air flow, the flame-shaped head 5 drives the spring 4 to disturb, and the spring 4 then drives the flame-shaped head 5 to rock and generate flickering effect. The electrical connection of Embodiment 3 is shown as follows: The electrodes of the light source 61 are directly connected to the light source control unit (not shown in the figure), and the light source control unit controls the light source to turn on and off or flicker to achieve different simulation effects.

Figure 10:
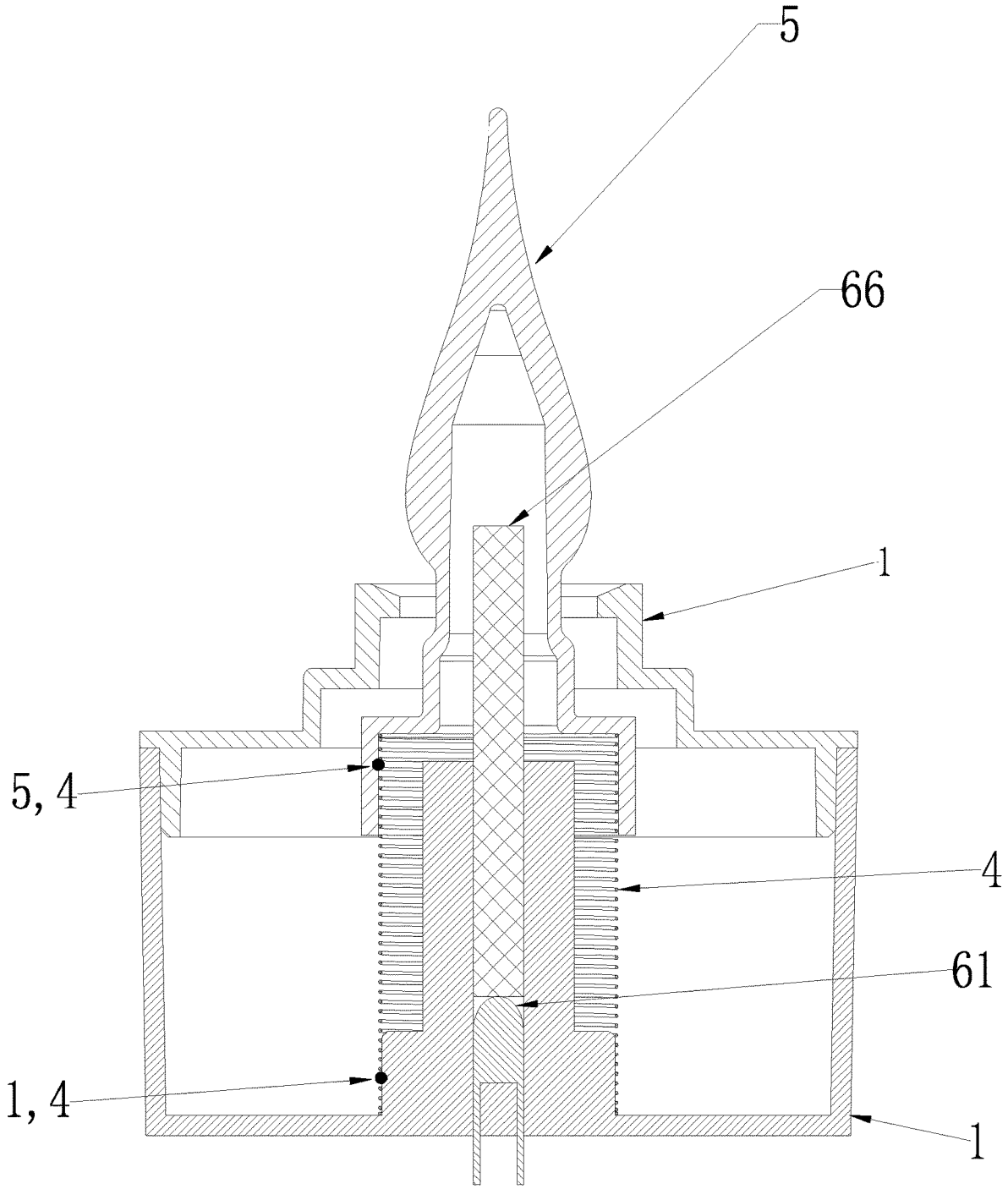
FIG. 10 is a schematic diagram depicting the cross-sectional view of Embodiment 4 of a flickering flame-shaped head apparatus in the present invention.

Embodiment 4 is shown in FIG. 10: a flickering-style flame-shaped head apparatus is composed of housing 1, flame-shaped head 5, light source 61, and spring 4, the apparatus also includes a transparent light pipe 66 connected to the light source 61; the housing 1 has an inner space and an upper opening, and the flame-shaped head 5 consists of a three-dimensional flame-shaped part with an interior hollow structure, the flame-shaped head 5 is at least partially located above the upper opening of the housing 1; the light source 61 is disposed inside the housing 1; and the flame-shaped head 5 is illuminated by the light beam emitted by the light source 61 (such light beam passes through the transparent light pipe 66 to the inner space of flame-shaped head 5 and then is emitted through from inside to outside). The spring 4 has upper and lower ends, the flame-shaped head 5 is supported on the upper end of the spring 4, the disturbance of the spring 4 drives the flame-shaped head 5 to move relative to the housing 1.

In the description of this specification, the terms "first" and "second" are only used for the purpose of description, and cannot be understood as indicating or implying relative importance; the terms "multiple" refer to two or more, unless otherwise clearly defined; the position or position relationship of the terms "up" and "down" are based on the orientation or position relationship shown in the attached drawings, which is only for the convenience of describing the invention, rather than indicating or implying that the device or unit referred to must have a specific direction, be constructed and operated in a specific direction, therefore, it cannot be understood as a limitation of the invention; the terms "installation", "connection", "connection", "support", "fixation" etc. should be understood in a broad sense, for example, "connection" can be a fixed connection or a detachable connection; "Connected" can be directly connected or indirectly connected through intermediate media. For those ordinary technicians in the art, the specific meaning of the above terms in the invention can be understood according to the specific situation.

It should be understood that the above embodiments are only used to illustrate the technical solutions of the invention, rather than to restrict them. For those technicians in the art, the technical solutions recorded in the above embodiments can be modified, or some technical features therein can be equivalently replaced; and these modifications and substitutions shall belong to the protection scope of the claims attached to the invention.

What is claimed is:

1. A flickering flame-shaped head apparatus, comprising:

a housing including an inner space and an upper opening;

a flame-shaped head including a three-dimensional flame-shaped part with an interior hollow structure, the flame-shaped head is at least partially located above the upper opening of the housing;

a light source disposed within the flame-shaped head, the flame-shaped head is illuminated by a light emitted by the light source, from inside to outside;

a spring including an upper and a lower ends, the flame-shaped head is supported on the upper end of the spring.

2. The apparatus of claim 1, wherein the lower end of the spring is supported on the housing, the spring having an inner space that penetrates both upper and lower portions thoroughly, which is surrounded by a spring wire including a diameter of less than 0.5 millimeters, the housing including a light source fixing protrusion passing through the inner space of the spring, the light source is fixed on the upper end of the light source fixing protrusion.

3. The apparatus of claim 1, further comprising a driving device configured to disturb the spring by driving the spring to rotate; and wherein the wire diameter of the spring is less than 0.5 millimeters.

4. The apparatus of claim 1, further comprising a spring support and a driving device, wherein the lower end of the spring is supported on the spring support, the driving device drives the spring support to move relative to the housing, so that causes the disturbance of the spring; and wherein the wire diameter of the spring is less than 0.5 millimeters.

5. A flickering flame-shaped head apparatus, comprising:

a housing including an inner space and an upper opening;

a flame-shaped head including a three-dimensional flame-shaped part with an interior hollow structure, the flame-shaped head is at least partially located above the upper opening of the housing;

a light source disposed within the flame-shaped head, the flame-shaped head is illuminated by a light emitted by the light source, from inside to outside;

a spring including an upper and a lower ends, the light source is coupled to the upper end of the spring.

6. The apparatus of claim 5, further comprising at least one light source conductive wire having a diameter of less than 0.5 millimeters, wherein one end of the at least one light source conductive wire is electrically connected to at least one electrode of the light source and the other end of the at least one light source conductive wire is electrically connected to a light source control unit; and wherein a wire diameter of the spring is less than 0.5 millimeters.

7. The apparatus of claim 6, wherein the at least one light source conductive wire is enameled wire, bare metal wire or metal electroplated fiber wire.

8. The apparatus of claim 6, further comprising a light source fixing plug including an inner space, wherein the upper end of the spring, passing through the inner space of the light source fixing plug, is coupled to the light source, and the flame-shaped head is coupled to the light source fixing plug.

9. The apparatus of claim 8, wherein the spring includes an inner space surrounded by a spring wire, at least one section of the light source conductive wire is located in the inner space of the spring.

10. The apparatus of claim 9, wherein the spring serves as a conductor, the upper end of the spring is electrically connected to at least one electrode of the light source, the lower end of the spring is electrically connected to the light source control unit.

11. The apparatus of claim 10, wherein the light source fixing plug includes two halves.

12. The apparatus of claim 11, wherein the at least one light source conductive wire is enameled wire, bare metal wire or metal electroplated fiber wire.

13. The apparatus of claim 11, further comprising a spring support and a driving device, wherein the lower end of the spring is supported on the spring support, and the driving device drives the spring support to move relative to the housing, thereby causing disturbance of the spring.

14. The apparatus of claim 11, further comprising a motor driving the spring to disturb, wherein a first light source electrode is electrically connected to the upper end of the light source conductive wire, the lower end of the light source conductive wire is electrically connected to a motor rotating shaft, a metal housing surface of the motor is electrically connected to the light source control unit, so that the first light source electrode is electrically connected to the light source control unit through the light source conductive wire, the rotating shaft and the metal housing surface of the motor in turn, and a second light source electrode is electrically connected to the upper end of the spring, the lower end of the spring is electrically connected to the light source control unit.

15. The apparatus of claim 5, further comprising a driving device configured to drive the spring to rotate to generate disturbance of the spring.

16. The apparatus of claim 5, further comprising a conductive ring and a conductive elastic sheet, wherein the conductive ring includes an annular outer surface and coupled to the lower end of the spring, the conductive ring is electrically connected to at least one electrode of the light source, the movement of the conductive ring causes the disturbance of the spring; and wherein the conductive elastic sheet includes an elastic end and a fixed end, the fixed end of the conductive elastic sheet is coupled to the housing, the elastic end of the conductive elastic sheet is electrically coupled to the annular outer surface of the conductive ring, the conductive elastic sheet is electrically connected to the light source control unit.

17. The apparatus of claim 5, further comprising a spring support and a driving device, wherein the lower end of the spring is supported on the spring support, and the driving device drives the spring support to move relative to the housing, thereby causing disturbance of the spring.

18. The apparatus of claim 5, wherein the number of the springs should be at least two, the upper ends of the at least two springs are respectively connected to at least two electrodes of the light source, the lower ends of the at least two springs are electrically connected to a light source control unit.

19. The apparatus of claim 18, wherein one of the at least two springs includes an inner space surrounded by a spring wire, the other spring is located in the inner space.

20. A flickering flame-shaped head apparatus, comprising:

a housing including an inner space and an upper opening;

a flame-shaped head including a three-dimensional flame-shaped part with an interior hollow structure, the flame-shaped head is at least partially located above the upper opening of the housing;

a light source disposed inside the housing;

a transparent light pipe coupled to the light source;

a spring including an upper and a lower ends, the flame-shaped head is supported on the upper end of the spring, the disturbance of the spring drives the flame-shaped head to move relative to the housing;

wherein the flame-shaped head is illuminated by a light beam emitted by the light source, such light beam passes through the transparent light pipe to an inner space of flame-shaped head and then is emitted through from inside to outside.

* * * * *